United States Patent [19]

Harris

[11] Patent Number: 5,044,898

[45] Date of Patent: Sep. 3, 1991

[54] FUEL INJECTION PUMP

[75] Inventor: Kenneth M. Harris, Maidstone, England

[73] Assignee: Lucas Industries, England

[21] Appl. No.: 472,884

[22] Filed: Jan. 31, 1990

[30] Foreign Application Priority Data

Feb. 9, 1989 [GB] United Kingdom ..... 8902860

[51] Int. Cl.[5] ..... F04B 19/02

[52] U.S. Cl. ..... 417/462; 417/304; 417/311; 123/450; 123/506

[58] Field of Search ..... 417/462, 463, 307, 311, 417/302, 304; 123/450, 506

[56] References Cited

U.S. PATENT DOCUMENTS

| | | | |
|---|---|---|---|
| 4,083,345 | 4/1978 | Davis | 123/450 |
| 4,224,903 | 9/1980 | Mowbray | 123/506 |
| 4,448,165 | 5/1984 | Skinner | 123/450 |
| 4,531,491 | 7/1985 | Iiyama et al. | 123/450 |
| 4,709,673 | 12/1987 | Babitzka | 123/450 |
| 4,896,645 | 1/1990 | Potter | 123/450 |

*Primary Examiner*—Leonard E. Smith
*Assistant Examiner*—M. Kocharov
*Attorney, Agent, or Firm*—Andrus, Sceales, Starke & Sawall

[57] ABSTRACT

A rotary distributor type fuel pumping apparatus for supplying fuel to an internal combustion engine has a distributor member an enlarged portion of which is formed with a transverse bore in which is mounted a pair of pumping plungers and blind bores located in side by side relationship with the transverse bores, the blind bores are located between the transverse bore and a body which supports the distributor member for rotation. The blind bores are in communication with drillings which lie in a plane containing the axes of the transverse bore and the blind bores and which extend from the end of the distributor member. The drillings interset the transverse bore that the ends of the drillings opening into the transverse bore are sealed by the pumping plungers.

2 Claims, 2 Drawing Sheets

FUEL INJECTION PUMP

Figure 1:
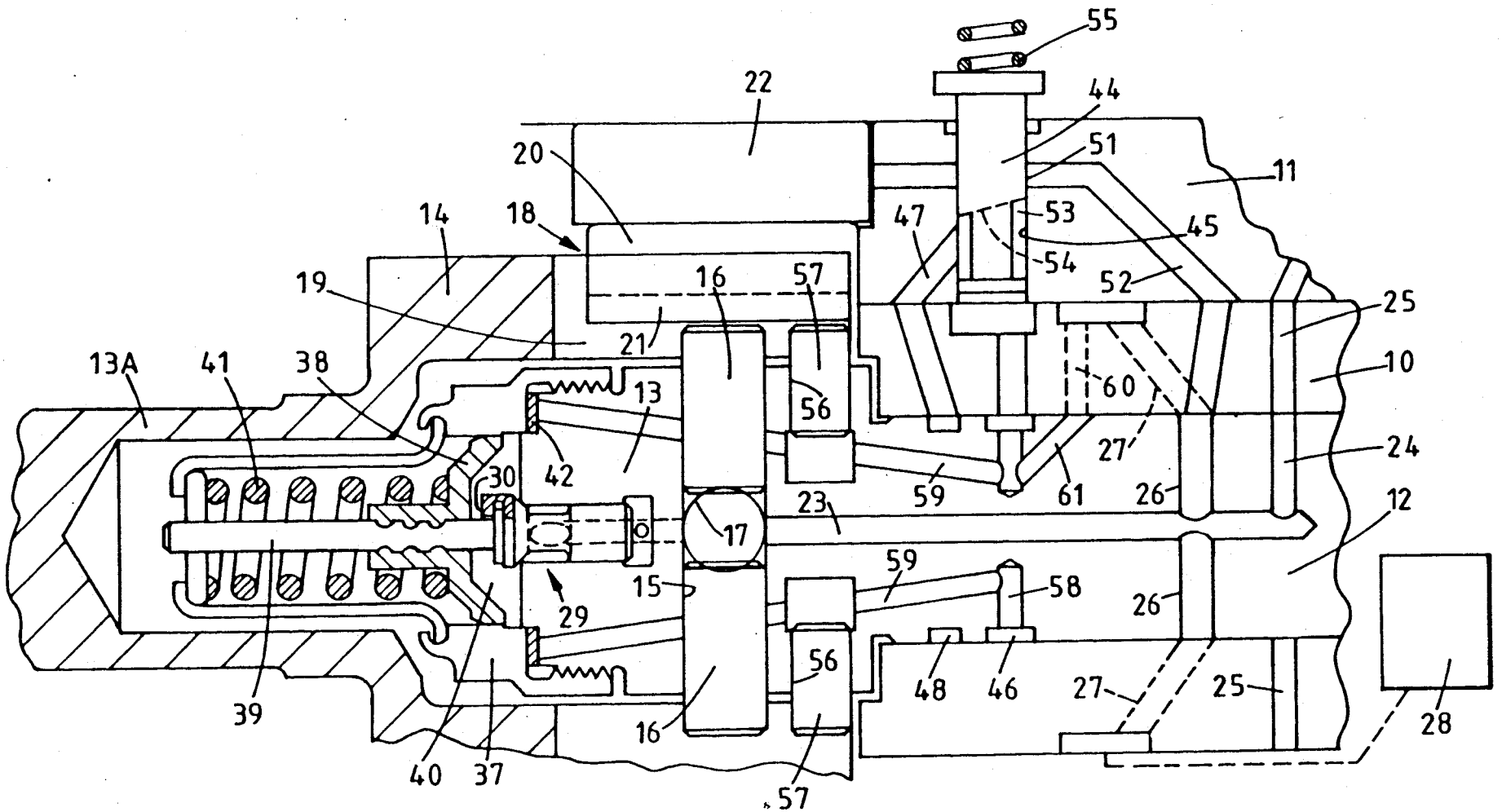

This invention relates to fuel injection pumps for supplying fuel to internal combustion engines and of the kind comprising a rotary distributor member rotatably mounted in a body, a portion of said distributor member projecting from the body, a transverse bore formed in said projecting portion of the distributor member and a pair of pumping plungers in said bore, cam followers at the outer ends of said plungers, said cam followers being engageable with cam lobes formed on the internal peripheral surface of a cam ring surrounding the projecting portion of the distributor member, passage means connected with said bore and through which fuel displaced from said bore during inward movement of the plungers can flow to outlet ports in turn formed in the body and through which fuel can be supplied to the bore from a source of fuel under pressure, a further plunger slidable in said portion of the distributor member, said further plunger being located in spaced side by side relationship relative to one of said pumping plungers and being actuated by the respective one of said cam followers, said further plunger delivering liquid to a spill control shuttle housed in said body.

The aforesaid passage means includes a longitudinal passage and a delivery passage which is connected with the longitudinal passage and extends to the periphery of the distributor member for registration with said outlet ports. It is conventional practice to ensure that the longitudinal passage since it contains fuel at high pressure, is located on the rotary axis of the distributor member since if there is dilation of the distributor member this will be even and can be allowed for when machining the distributor member and the bore in which it is located. A problem arises when an additional plunger or plungers is provided. The fuel displaced by these plungers must be conveyed to a cylinder containing the spill control shuttle which is located in the body and the displaced fuel has to be conveyed from said projecting portion of the distributor member into the portion of the distributor member in the body. If an additional pair of plungers is provided and is located in a transverse bore disposed on the side of the pumping plungers remote from the body a passage of complex shape has to be formed and this may comprise a series of drillings at odd angles in order to skirt round the bore which contains the pumping plungers. These drillings since in most cases they will extend to the periphery of the distributor member will require to be plugged. If on the other hand the transverse bore containing the additional pair of plungers is disposed between the pumping plungers and the body, the bore will traverse the longitudinal passage. The object of the present invention is provide a pump in which the above difficulties are overcome.

According to the invention the further plunger is positioned in a blind bore disposed between the pumping plungers and the body, the blind bore being connected to a drilling which is located in a plane containing the axes of the transverse bore and the blind bore, the drilling intersecting the transverse bore at a position where its point of entry into the transverse bore is covered by one of the pumping plungers.

Figure 2:
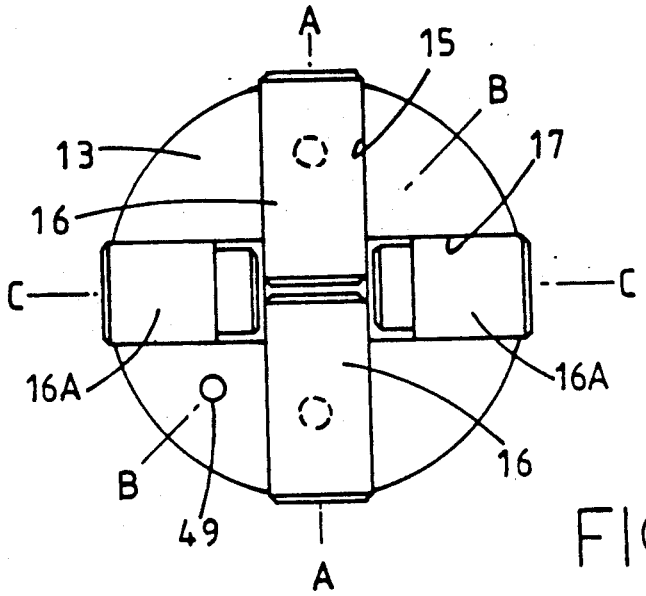
Figure 3:
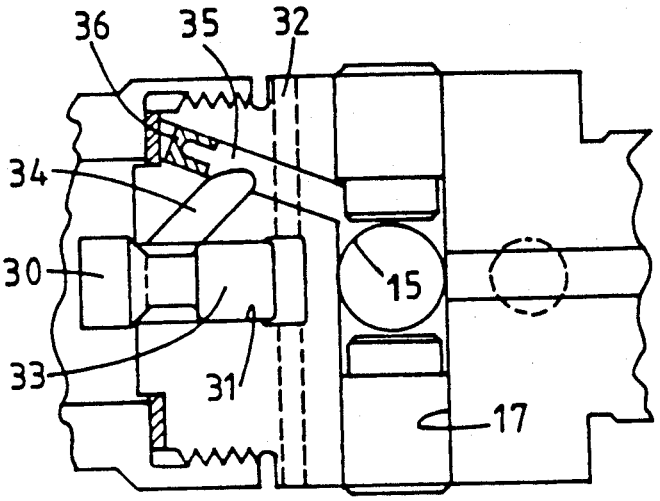
Figure 4:
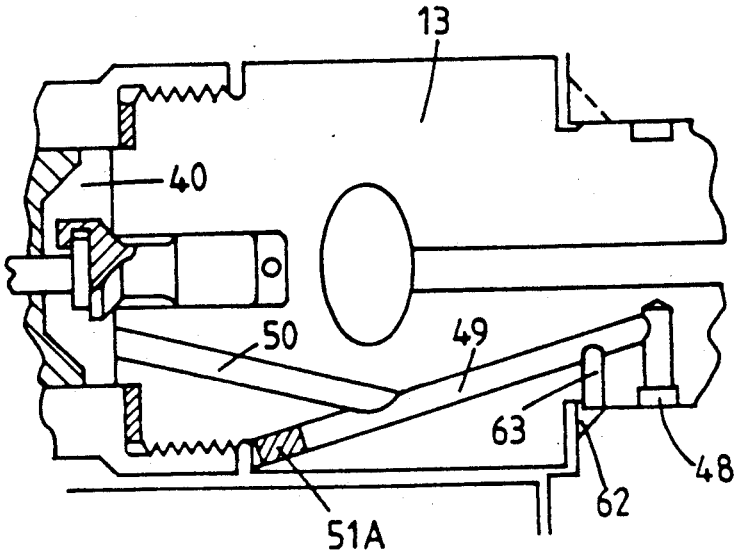

An example of the fuel injection pump in accordance with the invention will now be described with reference to the accompanying drawings in which:

FIG. 1 is a sectional side elevation of the pump with the section taken along the line AA of FIG. 2, FIG. 2 is a section through part of the pump shown in FIG. 1, FIG. 3 is a part sectional side elevation of part of the pump shown in FIG. 1 taken on the line CC of FIG. 2, and FIG. 4 is a view similar to FIG. 3 taken on the line BB of FIG. 2.

Referring to the drawings the pump comprises a body 10 which is in the form of a sleeve housed within a housing 11 of the pump. Mounted within the sleeve is a rotary distributor member 12 having a projecting portion 13 which extends from the bore in the sleeve. The distributor member is driven in timed relationship with the associated engine through a drive shaft 13A which has an enlarged portion 14 surrounding the projecting portion of the distributor member.

Formed in the projecting portion 13 of the distributor member is a transverse bore 15 in which is mounted a pair of pumping plungers 16. In the particular example a further transverse bore 17 is provided which is disposed at right angles to the bore 15 and it contains an additional pair of pumping plungers **16*a*. At their outer ends the pumping plungers are engaged by cam followers 18 which are located in slots 19 respectively formed in the enlarged portion 14 of the drive shaft. The cam followers include rollers 20 which are mounted in shoes 21 which engage with the outer ends of the pumping plungers. The rollers engage cam lobes formed on the internal peripheral surface of a cam ring 22 which surrounds the enlarged portion 14** of the drive shaft.

The space defined between the inner ends of the plungers 16 and **16*a* and which constitutes a pumping chamber is connected to one end of a longitudinal passage 23 which lies on the axis of rotation of the distributor member. At one point the longitudinal passage is in communication with a radially disposed delivery passage 24 which is positioned to register in turn during successive inward movements of the pumping plungers, with outlet ports 25** formed in the sleeve and which in use, are in communication with the injection nozzles of the associated engine.

The longitudinal passage 23 also communicates with radially disposed inlet passages 26 extending to the periphery of the distributor member and these passages can register with inlet ports 27 formed in the sleeve 10 and which communicate with a source 28 of fuel under pressure. Conveniently the source 28 comprises a vane pump the rotary part of which is mounted on the distributor member.

Ignoring for the moment the remaining parts of the pump, and in particular the fuel quantity control, the pump as described operates in the following manner. As shown in FIG. 1 the delivery passage 24 is in register with an outlet port 25 and the inlet passage 26 are out of register with the inlet passage 27. The plungers are being moved inwardly by the cam lobes and fuel is therefore being delivered to an injection nozzle of the associated engine. As rotation of the distributor member takes place, the delivery passage 24 moves out of register with an outlet port 25 and the inlet passages 26 move into register with the inlet ports. Fuel can now be supplied by way of the longitudinal passage to the aforesaid pumping chamber to effect outward movement of the plungers 16 and **16*a*** as permitted by the cam lobes. Thereafter the cycle as described is repeated.

In order to provide for control of the quantity of fuel supplied by the pump, a spill valve indicated at 29 is provided and which is opened in the particular example, after a predetermined inward movement of the pumping plungers has taken place. The spill valve comprises a valve member having a head 30 which can cooperate with a seating formed at the outer end of a blind bore 31 which is disposed in the end face of the projecting portion of the distributor member. The valve member has a cylindrical portion 33 slidable within the bore 31 and beneath the head the valve member is of reduced diameter to form an annular space with which communicates a passage 34 which is drilled from the end face of the distributor member and which breaks into a further passage 35 which again is drilled inwardly from the end face of the distributor member and which opens into the bore 17. The end of the passage 35 remote from the bore is plugged by means of a plug 36. Mounted about the free end of the projecting portion 13 of the distributor member is a housing 37 which defines a bore to receive a piston member 38. The piston member 38 carries a rod 39 having a head which engages beneath a projecting portion on the head 30 of the spill valve. Between the piston 38 and the end surface of the distributor member is defined a spill chamber 40 and the piston member is biased by means of a spring 41 towards the distributor member and the spring acts to maintain the head 30 of the spill valve member in engagement with its seating. Interposed between the housing 37 which is in screw thread engagement with the distributor member, is a washer 42 which serves to prevent movement of the plug 36.

The spill chamber 40 is supplied as will be explained, with a control pressure and this acts upon the piston member 38 to move it against the action of the by an amount sufficient to lift the head 30 of the spill valve member from its seating. This occurs during the inward movement of the plungers 16, 16A and as soon as the head 30 is lifted from the seating fuel from the pumping chamber flows into the spill chamber 40 so that the pressure of fuel in the pumping chamber is quickly lowered and the remaining quantity of fuel displaced from the pumping chamber will flow into the spill chamber thereby moving the piston outwardly, instead of to the associated engine. The lowering of the pressure in the pumping chamber means that the stresses in the rollers 20 and the cam lobes are substantially reduced as the rollers move over the crest of the cam lobes. When the plungers are allowed to move outwardly, the spring 41 displaces the piston towards the distributor member and fuel contained in the spill chamber flows back to the pumping chamber.

The aforesaid control pressure is in fact fuel at the high pressure generated within the pumping chamber and its supply to the spill chamber is controlled by a spill control shuttle 44 which is slidably accommodated within a shuttle bore 45 located in a portion of the housing 11 which surrounds the sleeve 10. The inner end of the bore 45 communicates with a circumferential groove 46 formed on the periphery of the distributor member. Extending from the shuttle bore 45 is a passage 47 which also communicates with a circumferential groove 48 formed on the periphery of the distributor member and this groove as shown in FIG. 4, communicates with the spill chamber 40 by way of a pair of drillings 49, 50 formed in the projecting portion 13 of the distributor member. As will be seen from FIG. 4 both drillings are drilled from the exterior of the distributor member and the drilling 49 is provided with a plug 51A. Also formed in the shuttle bore 45 is a port 51 which communicates with a passage 52 extending to the periphery of the distributor member to communicate with an inlet passage 26 during the time when the delivery passage 24 is in communication with an outlet 25. The port 51 is arranged to be uncovered to an annular space 53 formed by a reduced portion of the shuttle 44, the space being bounded by an inclined control edge 54. The space 53 is in constant communication with the passage 47.

The shuttle 44 is biased inwardly by a coiled compression spring 55 and is movable outwardly by fuel which is supplied to the inner end of the bore 45 from the circumferential groove 46.

The groove 46 communicates with the inner ends of a pair of blind bores 56 which contain an additional pair of plungers 57 of smaller diameter than the pumping plungers 16, 16*a*. The additional pair of plungers 57 and the associated bores are positioned intermediate the plungers 16 and the body 10 and furthermore, lie in the same transverse plane as the plungers 16. The plungers 57 are engaged by the cam followers which actuate the plungers 16. The inner ends of the bores 56 are connected to blind radial passages 58 extending inwardly from the groove 46, by way of passages 59 respectively. The passages 59 lie in the aforesaid plane and are drilled from the end face of the projecting portion of the distributor member. The passages 59 therefore intersect the transverse bore 15 but the drillings are positioned so that the plungers 16 cover the entrances of the passages 59 into the transverse bore. In addition, the washer 42 closes the passages 59.

In operation, the plungers 57 are moved inwardly at the same time as the pumping plungers 16, 16*a* and as they move inwardly fuel is displaced to the inner end of the shuttle bore 45. Delivery of fuel to the associated engine continues to take place until the outward movement of the shuttle uncovers the port 51 and when this occurs fuel supplied to the port 51 from one of the inlet passages 26, flows by way of the passage 47, the circumferential groove 48 and the drillings 49, 50 to the spill chamber 40 and this flow of fuel effects the initial movement of the piston 38 to move the head of the valve member 30 away from its seating so that spillage of fuel takes place as described. The angular setting of the shuttle 44 can be adjusted so that the instant at which spillage of fuel takes place and therefore the quantity of fuel which is supplied to the associated engine can be varied. As the distributor member continues to rotate and the rollers move over the crest of the cam lobes, the shuttle 44 will move inwardly under the action of its spring 55. The fuel displaced by the shuttle will be returned to the bores 56 to effect outward movement of the plungers 57 but in order to make up any fuel which may be lost, an additional filling port 60 is provided which is connected to the outlet of the pump 28 and which is brought into communication with a passage 61 which is in constant communication with the groove 46. The force exerted by the spring 55 is sufficient to ensure that the shuttle does move inwardly even though it is subject to the outlet pressure of the low pressure pump 28. At the end of the filling period therefore the plungers 57 have moved outwardly their maximum extent as determined by the cam profile and the shuttle 44 is at its innermost position.

The piston member 38 during its final movement, will move the head of the spill valve into engagement with its seating and in order to ensure that the spill chamber 40 together with the various passages connected thereto, are at a low known pressure, there is provided as shown in FIG. 4, a series of grooves 62 with which can register a passage 63 connected with the drilling 49 and therefore with the spill chamber 40. The passage 63 is arranged to register with a groove 62 before the end of the filling period of the pumping chamber and this will ensure that the spill chamber 40 is depressurized to the pressure of fuel which pertains in the housing of the apparatus.

The pump as described is for supplying fuel to a four cylinder engine and two pairs of cam lobes are provided the cam lobes being disposed at intervals of 90 degrees. If the pump is intended to supply fuel to a six cylinder engine then the bore 17 is displaced through 30 degrees from the position shown in FIG. 2 and the number of outlet ports and inlet ports and passages is increased and three pairs of cam lobes are provided adjacent cam lobes being disposed at 60 degrees relative to each other.

I claim:

1. A fuel injection pump for supplying fuel to an internal combustion engine and of the kind comprising a rotary distributor member rotatably mounted in a body, a portion of the distributor member extending from the body, a transverse bore formed in said projecting portion and a pair of pumping plungers in the bore, cam followers at the outer ends of the plungers the cam followers being engageable with cam lobes formed on the internal peripheral surface of a cam ring surrounding the portion of the distributor member, passage means through which fuel displaced from said bore can flow to outlet ports in turn and through which fuel can be supplied to the bore from a source or fuel under pressure, a further plunger slidable in said portion of the distributor member said further plunger being located in spaced side by side relationship relative to one of said pumping plungers and being actuated by the respective one of said cam followers, said further plunger delivering liquid to a spill control shuttle housed in said body characterized in that the further plunger is positioned in a blind bore disposed between the pumping plungers and the body, the blind bore being connected to a drilling which is located in a plane containing the axis of the transverse bore and the blind bore, the drilling intersecting the transverse bore at a position where its point of entry onto the transverse bore is covered by one of the pumping plungers.

2. An injection pump according to claim 1 characterized in that the drilling extends inwardly from the end of the enlarged portion of the distributor member and the open end of the drilling is closed by a washer which is secured adjacent the end of the distributor by a housing.

* * * * *